US008534774B1

(12) United States Patent
Chang

(10) Patent No.: US 8,534,774 B1
(45) Date of Patent: Sep. 17, 2013

(54) ATTACHMENT SYSTEM FOR MODULAR COMPOSITE CABINET SYSTEMS

(76) Inventor: Yan Chang, Temecula, CA (US)

( * ) Notice: Subject to any disclaimer, the term of this patent is extended or adjusted under 35 U.S.C. 154(b) by 47 days.

(21) Appl. No.: 13/401,254

(22) Filed: Feb. 21, 2012

(51) Int. Cl.
*F16B 12/00* (2006.01)

(52) U.S. Cl.
USPC ..... 312/111

(58) Field of Classification Search
USPC ..... 312/107, 108, 111, 257.1, 263, 352, 312/198
See application file for complete search history.

(56) References Cited

U.S. PATENT DOCUMENTS

| | | | | |
|---|---|---|---|---|
| 722,709 | A * | 3/1903 | Hunter | 312/107 |
| 1,254,636 | A * | 1/1918 | Barghausen | 312/111 |
| 1,434,220 | A * | 10/1922 | Morris | 312/107 |
| 2,920,781 | A * | 1/1960 | Butcher et al. | 217/12 R |
| 3,000,680 | A * | 9/1961 | Zelenko | 312/111 |
| 3,822,924 | A * | 7/1974 | Lust | 312/111 |
| 4,078,342 | A | 3/1978 | Cohen | |
| 4,810,551 | A * | 3/1989 | Chu | 428/106 |
| 5,088,619 | A * | 2/1992 | Shank | 220/532 |
| 5,951,127 | A | 9/1999 | Smith | |
| 6,053,585 | A * | 4/2000 | Osen | 312/204 |
| 6,769,750 | B2 * | 8/2004 | Hughes et al. | 312/265.5 |
| 7,960,004 | B2 | 6/2011 | Yee et al. | |
| 2007/0049152 | A1 | 3/2007 | Ou | |
| 2010/0015420 | A1 | 1/2010 | Riebel et al. | |
| 2010/0079042 | A1 | 4/2010 | Eilers et al. | |
| 2010/0253194 | A1 | 10/2010 | Wang | |
| 2010/0253195 | A1 * | 10/2010 | Owens | 312/351.2 |
| 2010/0258574 | A1 * | 10/2010 | Bentley | 220/592.2 |
| 2011/0123809 | A1 | 5/2011 | Riebel et al. | |
| 2011/0241504 | A1 * | 10/2011 | Xu | 312/111 |
| 2012/0242200 | A1 * | 9/2012 | Keragala | 312/111 |

* cited by examiner

*Primary Examiner* — Janet M Wilkens

(57) ABSTRACT

This invention features a modular composite cabinet system for facilitating multiple configurations of a variety of interconnecting modules. The system has one or more cabinet modules with one or more composite panels. The exterior surface has one or more pre-cut elongated slots with a depth equal to a thickness of a layer. A first cabinet module attaches to a second cabinet module using one or more attaching screws driven into an interior surface, exiting through a pre-cut elongated slot on the exterior surface, further driven through a second pre-cut elongated slot on the second cabinet module, into, then lodging into the substrate. A plurality of cabinet modules can be attached, then detached, then reattached in multiple configurations.

2 Claims, 4 Drawing Sheets

ATTACHMENT SYSTEM FOR MODULAR COMPOSITE CABINET SYSTEMS

BACKGROUND OF THE INVENTION

The use of cabinets has been employed by mankind for a long time. Cabinets have been constructed from many materials including solid and engineered wood components. Some of the more popular wood components include various hardwoods, plywood and chipboard. The present invention combines the qualities of a composite wood panel with the usefulness and versatility of a modular cabinet system with components that can be removed and reconnected numerous times.

SUMMARY

The present invention features a modular composite cabinet system for facilitating multiple configurations using a variety of interconnecting modules. The system has one or more cabinet modules with each cabinet module having one or more composite panels. The panel exterior surface of the composite panel has one or more pre-cut elongated slots with a depth equal to a layer thickness. These slots are used for attaching the interconnecting modules to each other.

In some embodiments, a first cabinet module attaches to a second cabinet module using one or more attaching screws driven into an interior surface, exiting through a pre-cut elongated slot on the exterior surface, further driven through a second pre-cut elongated slot on the second cabinet module, into, then lodging into the substrate. A plurality of cabinet modules can be attached, then detached, then reattached in multiple configurations.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
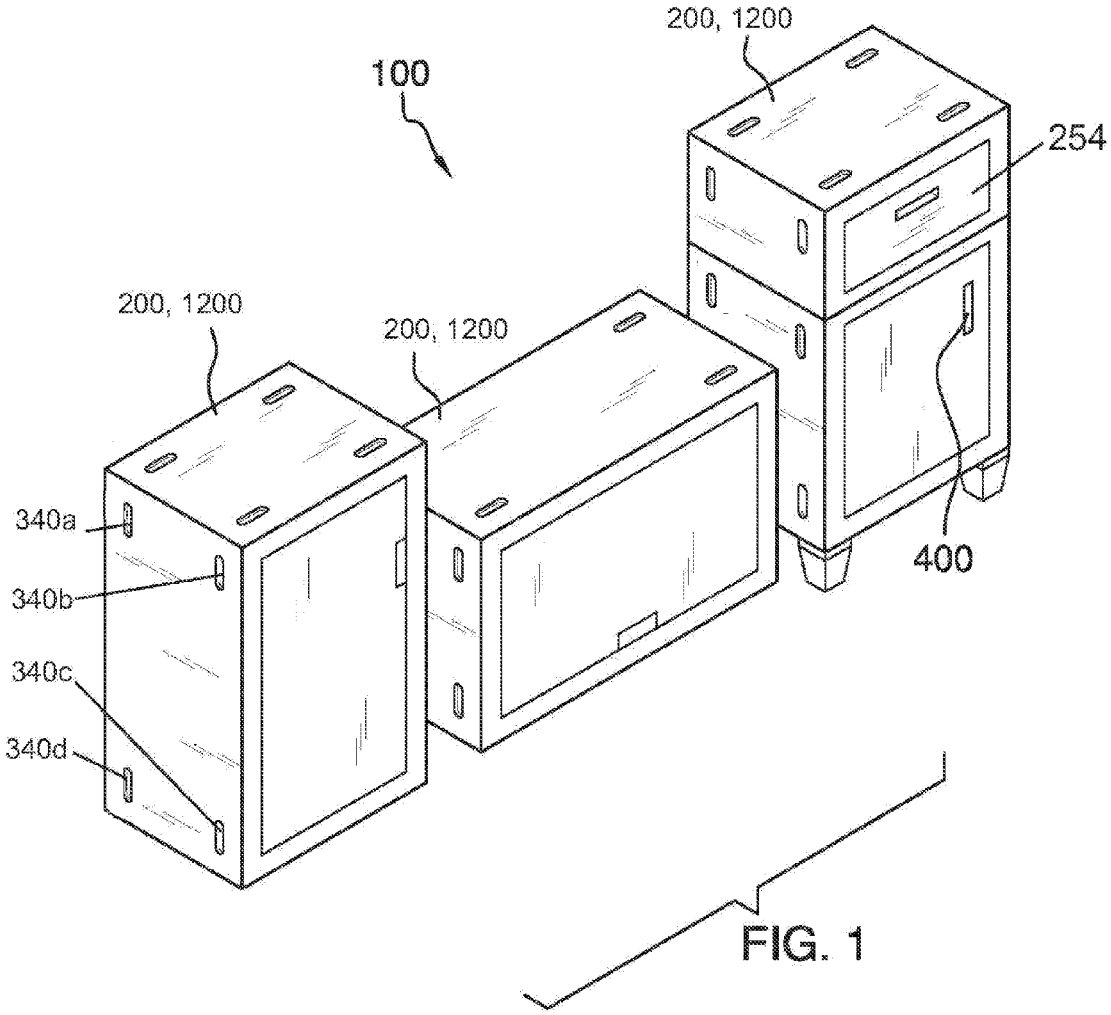
FIG. 1 is an isometric view of a modular composite cabinet system of the present invention
Figure 2:
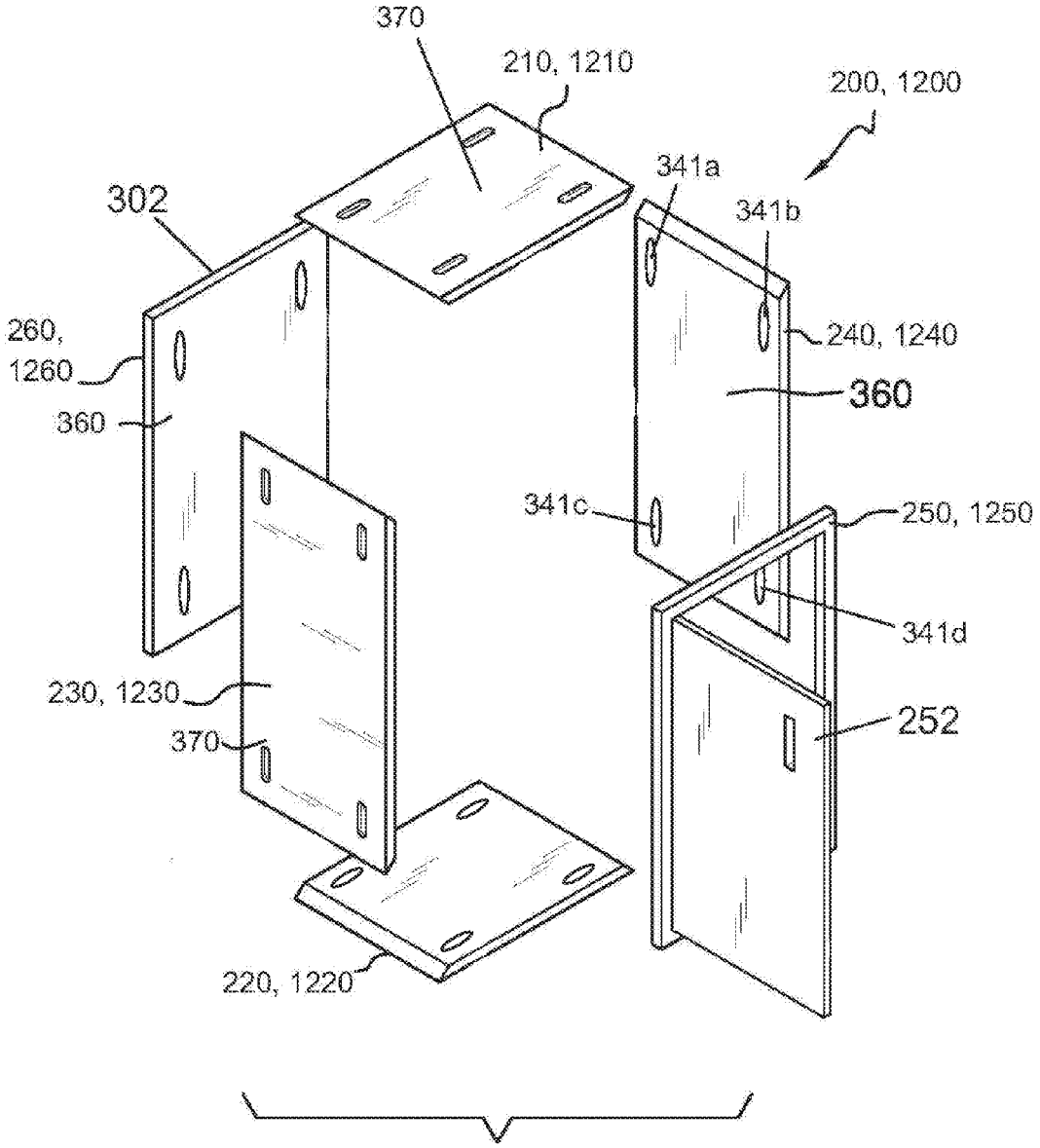
FIG. 2 is an exploded view of a cabinet module of the present invention.
Figure 3:
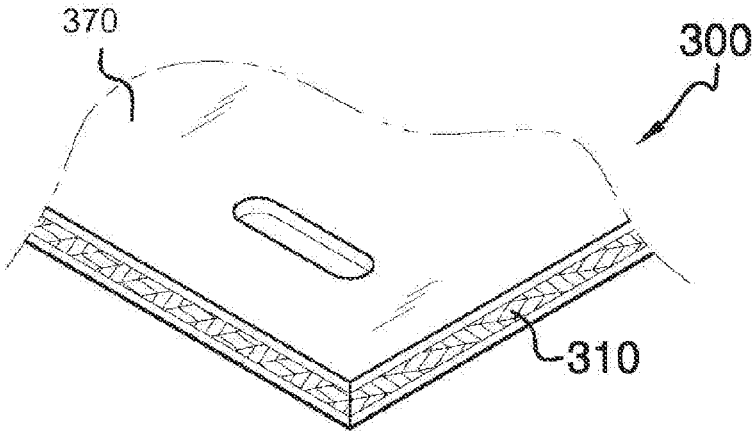
FIG. 3 is a close-up view of a pre-cut elongated slot of the present invention.
Figure 4:
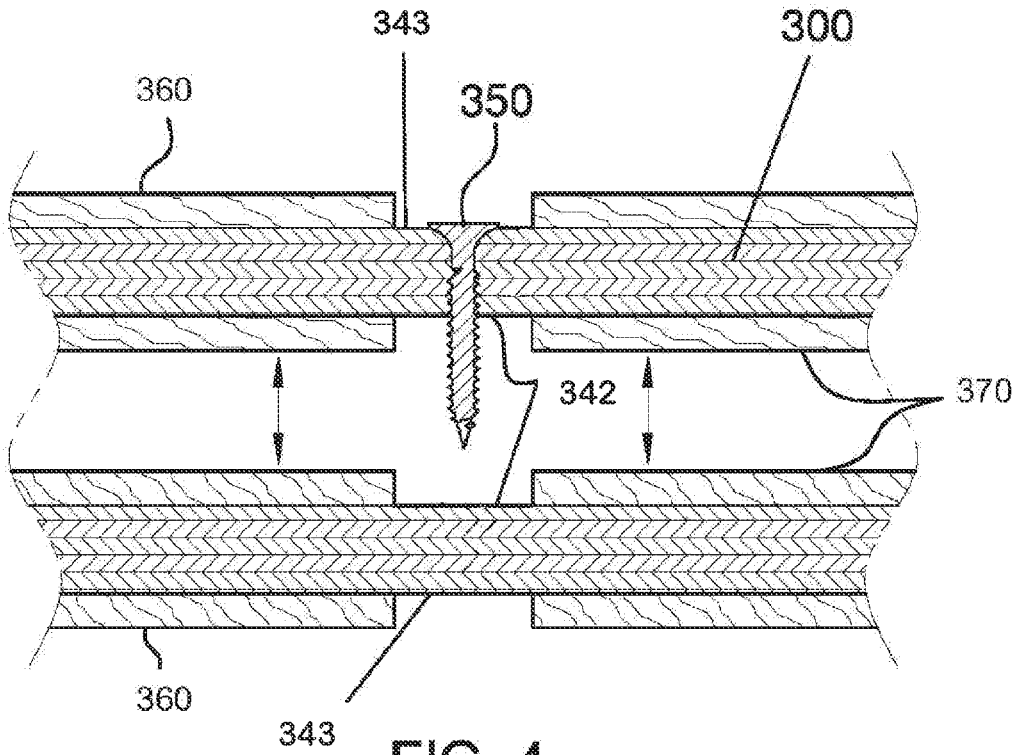
FIG. 4 is a cross-sectional view of two cabinet module sides of the present invention.
Figure 5:
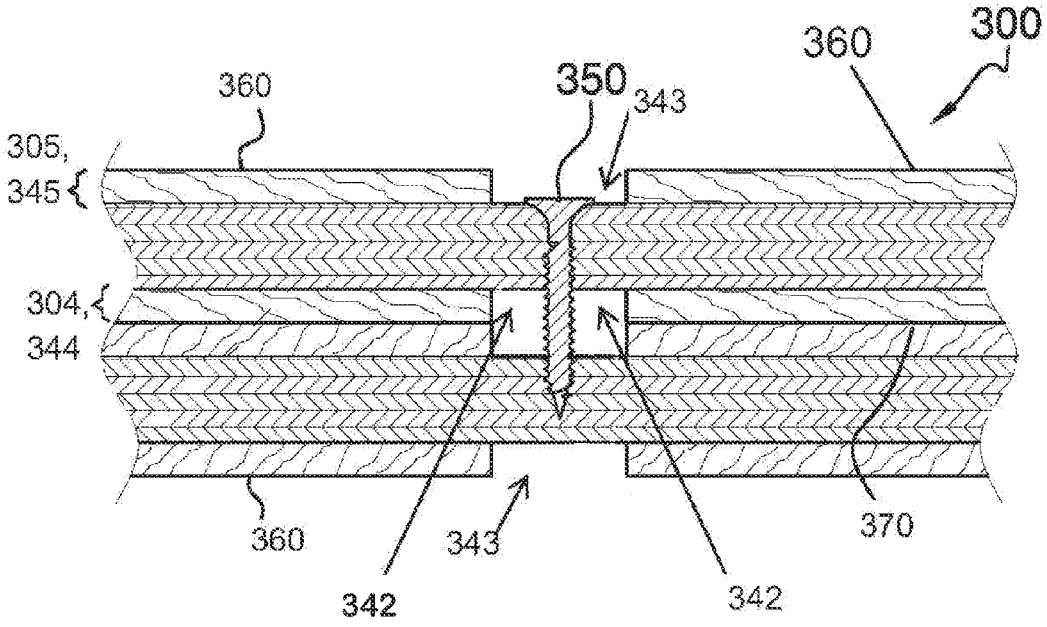
FIG. 5 is a cross-sectional view of two cabinet module sides of the present invention.

The following is a list of elements corresponding to a particular element referred to herein:

100 Modular composite cabinet system

150 Attachment system

200 First cabinet module, 1200 Second cabinet module

210 First module top side, 1210 Second module top side

220 First module bottom side 1220 Second module bottom side

230 First module first side, 1230 Second module first side

240 First module second side, 1240 Second module second side

250 First module front, 1250 Second module front

252 Module door

254 Module drawer face

260 First module back side, 1260 Second module back side

270 First module side, 1270 Second module side

300 Composite panel

302 Panel edge

304 Exterior layer thickness, 305 Interior layer thickness

310 Substrate

320 Panel interior surface

330 Panel exterior surface

Exterior pre-cut elongated slot, 340*a* First pre-cut elongated slot, 340*b* Second pre-cut elongated slot, 340*c* Third pre-cut elongated slot, 340*d* Fourth pre-cut elongated slot, 341 Interior pre-cut elongated slot, 341*a* Fifth pre-cut elongated slot, 341*b* Sixth pre-cut elongated slot, 341*c* Seventh pre-cut elongated slot, 341*d* Eighth pre-cut elongated slot

342 Exterior slot depth, 343 Interior slot depth

344 Exterior slot height, 345 Interior slot height

350 Attaching screw

360 Bamboo layer interior surface

370 Bamboo layer exterior surface

400 Handle/finger-pull

The present invention features an attachment system (150) for attaching a first composite panel (300) to a second composite panel (300). In some embodiments, the system (150) comprises two composite panels (300), each composite panel (300) comprising a substrate (310), a panel interior surface (320), a panel exterior surface (330) disposed on the substrate (310), at least one pre-cut elongated slot (340 disposed on the panel exterior surface (330) comprising a slot depth (342) having a slot height (344) being equal to a layer thickness (304) of the panel exterior surface (330). In some embodiments, the pre-cut elongated slot (340) is at least 1 inch from a panel edge (302). In some embodiments, the attachment system (150) comprises at least one attaching screw (350).

In some embodiments, a first composite panel (300) attaches to a second composite panel (300) via one or more attaching screws (350). In some embodiments, the attaching screw (350) is driven into a first panel interior surface (320) of a first composite panel (300), through the substrate (310) of the first composite panel (300), exiting through a first pre-cut elongated slot (340) disposed on a first panel exterior surface (330) of the first composite panel (300), further driven through a second pre-cut elongated slot (340) disposed on a second panel exterior surface (330) of a second composite panel (300), into and through a portion of, then lodging into the substrate (310) of the second composite panel (300). In some embodiments, the first composite panel (300) may be detached from the second composite panel (300). In some embodiments, the first composite panel (300) may be reattached to the second composite panel (300) via one or more attaching screws (350)

In some embodiments, the composite panel (300) is a bamboo composite panel (302).

In some embodiments, an attachment method for attaching a first composite panel (300) to a second composite panel (300) comprises obtaining two composite panels (300). In some embodiments, each composite panel (300) comprises a substrate (310), a panel interior surface (320), a panel exterior surface (330), disposed on the substrate (310), and at least one pre-cut elongated slot (340) disposed on the panel exterior surface (330). In some embodiments, the pre-cut elongated slot (340) comprises a slot depth (342) having a slot height (344) being equal to a layer thickness (304) of the panel exterior surface (330). In some embodiments, the pre-cut elongated slot (340) is at least 1 inch from an edge of the side. In some embodiments, a first composite panel (300) attaches to a second composite panel (300) via one or more attaching screws (350).

In some embodiments, the method comprises obtaining an at least one attaching screw (350) and driving the attaching screw (350) into a first panel interior surface (320) of a first composite panel (300), through the substrate (310) of the first composite panel (300), exiting through a first pre-cut elongated slot (340) disposed on a first panel exterior surface (330) of the first composite panel (300), further driving the attaching screw (350) through a second pre-cut elongated slot (340) disposed on a second panel exterior surface (330) of a second composite panel (300), into and through a portion of, then lodging into the substrate (310) of the second composite panel (300). In some embodiments, the first composite panel (300) may be detached from the second composite panel (300). In some embodiments, the first composite panel (300) may be reattached to the second composite panel (300) via one or more attaching screws (350).

In some embodiments, the composite panel (300) is a bamboo composite panel (302).

In some embodiments, a modular composite cabinet system (100) for facilitating multiple configurations uses a variety of interconnecting modules comprising at least one cabinet module (200). In some embodiments, the cabinet module (200) comprises a module top (210), a module bottom (220), a module first side (230), a module second side (240), and a module back (260), herein collectively referred to as a module side (270), and a module front (250). In some embodiments, the module front (250) can comprise a module door (252) or a module drawer face (254). In some embodiments, the module bottom comprises pre-drilled screw holes to accommodate bun-feet.

In some embodiments, the system (100) comprises at least one module side (270) comprising a composite panel (300). In some embodiments, the composite panel (300) comprises a substrate (310), a panel interior surface (320), a panel exterior surface (330) disposed on the substrate (310), at least one pre-cut elongated slot (340) disposed on the panel exterior surface (330) comprising a slot depth (342) having a slot height (344) being equal to a layer thickness (304) of the panel exterior surface (330). In some embodiments, the pre-cut elongated slot (340) is at least 1 inch from an edge of the side, thus facilitating intermodule connectability. In some embodiments, the system (100) comprises at least one attaching screw (350).

In some embodiments, a first cabinet module (200) attaches to a second cabinet module (200) via one or more attaching screws (350). In some embodiments, the attaching screw (350) is driven into a first panel interior surface (320) of a first composite panel (300) of the first cabinet module (200), through the substrate (310) of the first composite panel (300) of the first cabinet module (200), exiting through a first pre-cut elongated slot (340) disposed on a first panel exterior surface (330) of the first composite panel (300) of the first cabinet module (200), further driven through a second pre-cut elongated slot (340) disposed on a second panel exterior surface (330) of a second composite panel (300) on the second cabinet module (200), into and through a portion of, then lodging into the substrate (310) of the second composite panel (300) on the second cabinet module (200).

In some embodiments, a plurality of cabinet modules (200) attach together. In some embodiments, the first cabinet module (200) may be detached from the second cabinet module (200). In some embodiments, the first cabinet module (200) may be reattached to the second cabinet module (200).

In some embodiments, the composite panel (300) is a bamboo composite panel (302).

In some embodiments, a modular composite cabinet system (100) for facilitating multiple configurations uses a variety of interconnecting modules that are easily connectable. In some embodiments, a modular composite cabinet system (100) comprises a first cabinet module (200) and a second cabinet module (1200). In some embodiments, the first cabinet module (200) comprises a first module top side (210), a first module bottom side (220), a first module first side (230), a first module second side (240), and a first module back side (260). In some embodiments, the first cabinet module (200) further comprises a first module front (250). In some embodiments, the second cabinet module (1200) comprises a second module top side (1210), a second module bottom side (1220), a second module first side (1230), a second module second side (1240), and a second module back side (1260). In some embodiments, the second cabinet module (1200) further comprises a second module front (1250). In some embodiments, the first module top side (210), the first module bottom side (220), the first module first side (230), the first module second side (240), the first module back side (260), the second module top side (1210), the second module bottom side (1220), the second module first side (1230), the second module second side (1240), and the second module back side (1260) comprise a composite panel (300). In some embodiments, the composite panel (300) comprises a substrate (310). In some embodiments, the composite panel (300) comprises a bamboo layer interior surface (360) located on the substrate (310). In some embodiments, the composite panel (300) comprises a bamboo layer exterior surface (370) located on the substrate (310) opposed to the bamboo layer interior surface (360). In some embodiments, the composite panel (300) comprises a first pre-cut elongated slot (340*a*), a second pre-cut elongated slot (340*b*), a third pre-cut elongated slot (340*c*), and a fourth (pre-cut elongated slot (340*d*). In some embodiments, the first pre-cut elongated slot (340*a*), the second pre-cut elongated slot (340*b*), the pre-cut elongated slot (340*c*), and the fourth pre-cut elongated slot (340*d*) are located close to a different corner close to intersecting panel edges (302) on the bamboo layer exterior surface (370). In some embodiments, the composite panel (300) comprises a fifth pre-cut elongated slot (341*a*), a sixth pre-cut elongated slot (341*b*), a seventh pre-cut elongated slot (341*c*), and an eighth pre-cut elongated slot (341*d*). In some embodiments, the fifth pre-cut elongated slot (341*a*), the sixth pre-cut elongated slot (341*b*), the seventh pre-cut elongated slot (341*c*), and the eighth pre-cut elongated slot (341*d*) are located close to a different corner close to intersecting panel edges (302) on the bamboo layer interior surface (360). In some embodiments, the fifth pre-cut elongated slot (341*a*), the sixth pre-cut elongated slot (341*b*), the seventh pre-cut elongated slot (341*c*), and the eighth pre-cut elongated slot (341*d*) are located on the bamboo layer interior surface (360) opposed to the first pre-cut elongated slot (340*a*), the second pre-cut elongated slot (340*b*), the third pre-cut elongated slot (340*c*), and the fourth pre-cut elongated slot (340*d*) located on the bamboo layer exterior surface (370). In some embodiments, the fifth pre-cut elongated slot (341*a*), the sixth pre-cut elongated slot (341*b*), the seventh pre-cut elongated slot (341*c*), and the eighth pre-cut elongated slot (341*d*) comprise an interior slot depth (343) having an interior slot height (345) being equal to an interior layer thickness (305) of the bamboo layer interior surface (360). In some embodiments, the first pre-cut elongated slot (340*a*), the second pre-cut elongated slot (340*b*), the third pre-cut elongated slot (340*c*), and the fourth pre-cut elongated slot (340*d*) comprise an exterior slot depth (342) having an exterior slot height (344) being equal to an exterior layer thickness (304) of the bamboo layer exterior surface (370). In some embodiments, the first pre-cut elongated slot (340*a*), the second pre-cut elongated slot (340*b*), the third pre-cut elongated slot (340*c*), and the fourth pre-cut elongated slot (340*d*) are at least 1 inch from a panel edge (302). In some embodiments, the fifth pre-cut elongated slot (341*a*), the sixth pre-cut elongated slot (341*b*), the seventh pre-cut elongated slot (341*c*), and the eighth pre-cut elongated slot (341*d*) are at least 1 inch from a panel edge (302). In some embodiments, the composite panel (300) comprises an attaching screw (350). In some embodiments, the first cabinet module (200) attaches to the second cabinet module (1200) via the attaching screw (350). In some embodiments, the attaching screw (350) passes through the pre-cut elongated slot located on the bamboo layer interior surface (360) of the first cabinet module (200), through the substrate (310) of the first cabinet module (200), exiting through the pre-cut elongated slot located on the bamboo layer exterior surface (370) of the first cabinet module (200), further passing through the pre-cut elongated slot located on the bamboo layer exterior surface (370) on the second cabinet module (200), into and through a portion of, then lodging into the substrate (310) of the second cabinet module (1200). In some embodiments, the first cabinet module (200) may be detached from the second cabinet module (1200). In some embodiments, the first cabinet module (200) may be reattached to the second cabinet module (1200).

In some embodiments, the cabinet module (200) has a module top (210), a module bottom (220), a module first side (230), a module second side (240), a module front (250), and a module back (260). Each of these components can collectively be referred to as a module side (270). In some embodiments, the cabinet module (200) further has at least one module side (270) that has a composite panel (300). In some embodiments, a plurality of module sides (270) has composite panels (300). In some embodiments, each module side (270) consists of a composite panel (300). In some embodiments, the cabinet system is free of a module back. In some embodiments, the module backs comprises more slots than that of the other modules sides, for example, six or more slots in various arrangements. In some embodiments, the slots of the module backs are longer and/or wider than that of the other module sides.

In some embodiments, the composite panel (300) has a substrate (310). In some embodiments, the substrate (310) is plywood, wafer board, particle board or another engineered wood product manufactured from wood particles. In some embodiments, the substrate (310) is a solid wood such as pine. In some embodiments, the substrate (310) is a closed-cell extruded polystyrene foam or other foam. In some embodiments, the substrate is constructed from a plastic.

In some embodiments, the composite panel (300) has a panel interior surface (320) that is located on the substrate (310). The panel interior surface (320) may be a finished surface of the substrate (310) or the panel interior surface (320) may be another material such as bamboo, cedar or another wood located on the interior surface of the substrate (310).

In some embodiments, the panel exterior surface (330) is located on the substrate (310). The panel exterior surface (330) may be a natural finish or it may be stained or coated with a protective coating such as polyurethane or other protective coatings. In some embodiments, the panel exterior surface (330) is painted.

In some embodiments, the composite panel (300) is manufactured according to practices and materials of construction used by familiar to those with ordinary skill in the art. In some embodiments, the composite panel (300) is manufactured from materials that have low volatile organic compounds (VOCs). In some embodiments, the composite panel (300) is biodegradable.

In some embodiments, at least one pre-cut elongated slot (340) is located on the panel exterior surface (330). In some embodiments, there are a plurality of pre-cut elongated slots (340) located on the panel exterior surface (330). In some embodiments, there are four pre-cut slots (340) located on the panel exterior surface (330).

In some embodiments, the pre-cut elongated slot (340) has a slot depth (342) having a slot height (344) being equal to a layer thickness (304) of the panel exterior surface (330). In some embodiments, the pre-cut elongated slot (340) is cut only through the panel exterior surface (330). In some embodiments, the pre-cut elongated slot (340) is not cut fully through, but is cut partially through the panel exterior surface (330). In some embodiments, the pre-cut elongated slot (340) is cut entirely through the panel exterior surface (330) and partially into the substrate (310).

In some embodiments, the center of the pre-cut elongated slot (340) is at least 1 inch from an edge of the side to provide ease of connectability between the modules. This provides adequate clearance for a hand or a machine when driving the attaching screw (350) from inside the cabinet module (200).

In some embodiments, a first cabinet module (200) attaches to a second cabinet module (200) via one or more attaching screws (350). The attaching screw (350) is driven into a first panel interior surface (320) (and in some embodiments through a pre-cut elongated slot (340) on the interior) of a first composite panel (300) of the first cabinet module (200), through the substrate (310) of the first composite panel (300) of the first cabinet module (200), exiting through a first pre-cut elongated slot (340) located on a first panel exterior surface (330) of the first composite panel (300) of the first cabinet module (200), further driven through a second pre-cut elongated slot (340) located on a second panel exterior surface (330) of a second composite panel (300) on the second cabinet module (200), into and through a portion of, then lodging into the substrate (310) of the second composite panel (300) on the second cabinet module (200).

In some embodiments, the attaching screw (350) is coated with a non-corrosive coating. For example, a cadmium or a zinc compound, or paint.

In some embodiments, the attaching screw (350) is a clip. In some embodiments, the attaching screw (350) is a nail. In some embodiments, the attaching screw (350) is a bolt.

In some embodiments, a plurality of cabinet modules (200) attach together where a first cabinet module (200) may be detached from a second cabinet module (200). In some embodiments, the first cabinet module (200) may be reattached to the second cabinet module (200). In some embodiments, any number and combination of cabinet modules (200) may be attached, detached and reattached.

In some embodiments, the panel interior surface (320) has a bamboo layer interior surface (360) located on the substrate (310). The bamboo layer interior surface (360) has at least one pre-cut elongated slot (340) located on the bamboo layer interior surface (360) with the slot depth (342) having the slot height (344) being equal to the thickness of the bamboo layer of the bamboo layer interior surface (360). In some embodiments, the pre-cut elongated slot (340) is cut only through the bamboo layer interior surface (360). In some embodiments, the pre-cut elongated slot (340) is not cut fully through the bamboo layer interior surface (360). In some embodiments, the pre-cut elongated slot (340) is cut through the bamboo layer interior surface (360) into the substrate (310).

In some embodiments, the pre-cut elongated slot (340) has rounded corners. In some embodiments, the pre-cut elongated slot (340) has squared corners.

In some embodiments, the pre-cut elongated slot (340) has a bevelled edge.

In some embodiments, the pre-cut elongated slot (340) is between ⅛" and 1" long. In some embodiments, the pre-cut elongated slot (340) is between 1" and 4" long. In some embodiments, the pre-cut elongated slot (340) is greater than 4" long.

In some embodiments, the pre-cut elongated slot (340) is between ⅛" and 1" wide.

In some embodiments, the pre-cut elongated slot (340) is less than 1 inch from the edge of a side.

In some embodiments, the middle of the length of the pre-cut elongated slot (340) is located about 5" from the edge of the module side (270).

In some embodiments, the middle of the width of the pre-cut elongated slot (340) is located about 3" from the edge of the module side (270).

In some embodiments, the length of the pre-cut elongated slot (340) located on the module top (210), the module first side (230) or the module second side (240) runs parallel to an adjoining edge of the module front (250). In some embodiments, the length of the pre-cut elongated slot (340) located on the module top (210), the module first side (230) or the module second side (240) runs perpendicular to an adjoining edge of the module front (250).

In some embodiments, a handle/finger-pull (400) is located on the module front (250). In some embodiments, the handle/finger-pull (400) is a finished aperture through the module front (250) with smoothed edges. In some embodiments, the handle/finger-pull (400) is a rectangular aperture through the module front (250). In some embodiments, the handle/finger-pull (400) is disposed on a side of the module door (252) or a side of the module drawer face (254).

In some embodiments, a first cabinet module (200) attaches to a second cabinet module (200) via one or more attaching screws (350). An attaching screw (350) is driven through a pre-drilled hole in a first panel interior surface (320) (and in some embodiments through a pre-cut elongated slot (340) on the interior) of a first composite panel (300) of the first cabinet module (200), through a pre-drilled hole in the substrate (310) of the first composite panel (300) of the first cabinet module (200), exiting through a first pre-cut elongated slot (340) located on a first panel exterior surface (330) of the first composite panel (300) of the first cabinet module (200), further driven through a second pre-cut elongated slot (340) located on a second panel exterior surface (330) of a second composite panel (300) on the second cabinet module (200), into and through a portion of, then lodging into a substrate (310) of the second composite panel (300) on the second cabinet module (200).

In some embodiments, the pre-cut elongated slot (340) is filled with a flexible material, for example, silicone-based sealant, caulking, wood putty or wax. In some embodiments, the pre-cut elongated slot (340) can be refilled with the flexible material, for example, after disassembly or to fill in unneeded screw holes. In some embodiments, the flexible material is tinted to either match or coordinate with the surface finish of the module side (270). In some embodiments, the refilled flexible material is removable.

In some embodiments, the pre-cut elongated slot (340) has a cap that can be snapped into place to cover the pre-cut elongated slot (340). In some embodiments the cap is removable. In some embodiments, the cap is reusable. In some embodiments, the cap is flush with the surface of the module side (270). In some embodiments, the cap has a metal top, e.g., stainless steel.

In some embodiments, the pre-cut elongated slot (340) has a threaded insert for receiving a screw.

As used herein, the term "about" refers to plus or minus 10% of the referenced number. For example, an embodiment wherein a dimension is about 10 inches in length includes a dimension that is between 9 and 11 inches in length. For example, the middle of the length of the pre-cut elongated slot (340) is located about 5" from the edge of the module side (270), means that the middle of the length of the pre-cut elongated slot (340) is between 4½" and 5½" from the edge of the module side (270).

The disclosures of the following U.S. Patents are incorporated in their entirety by reference herein: U.S. Pat. No. 4,078,342; U.S. Pat. No. 5,951,127; U.S. Pat. No. 7,960,004 B2; US 2007/0049152 A1; US 2010/0015420 A1; US 2010/0079042 A1; US2010/0253194 A1; US 2010/0253195 A1; US 2011/0123809 A1.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A modular composite cabinet system (100) comprising a first cabinet module (200) and a second cabinet module (1200), wherein the first cabinet module (200) comprises a first module top side (210), a first module bottom side (220), a first module first side (230), a first module second side (240), and a first module back side (260), wherein the first cabinet module (200) further comprises a first module front (250), wherein the second cabinet module (1200) comprises a second module top side (1210), a second module bottom side (1220), a second module first side (1230), a second module second side (1240), and a second module back side (1260), wherein the second cabinet module (1200) further comprises a second module front (1250), wherein the first module top side (210), the first module bottom side (220) the first module first side (230), the first module second side (240), the first module back side (260), the second module top side (1210), the second module bottom side (1220), the second module first side (1230), the second module second side (1240), and the second module back side (1260) comprise a composite panel (300), wherein the composite panel (300) comprises:

(a) a substrate (310);

(b) a bamboo layer interior surface (360) disposed on the substrate (310);

(c) a bamboo layer exterior surface (370) disposed on the substrate (310), opposed to the bamboo layer interior surface (360);

(d) a first pre-cut elongated slot (340*a*), a second pre-cut elongated slot (340*b*), a third pre-cut elongated slot (340*c*), and a fourth pre-cut elongated slot (340*d*), wherein the first pre-cut elongated slot (340*a*), the second pre-cut elongated slot (340*b*), the third pre-cut elongated slot (340*c*), and the fourth pre-cut elongated slot (340*d*) are disposed proximal to a different corner proximal to intersecting panel edges (302) on the bamboo layer exterior surface (370), wherein a fifth pre-cut elongated slot (341*a*), a sixth pre-cut elongated slot (341*b*), a seventh pre-cut elongated slot (341*c*), and an eighth pre-cut elongated slot (341*d*), wherein the fifth pre-cut elongated slot (341*a*), the sixth pre-cut elongated slot (341*b*), the seventh pre-cut elongated slot (341*c*), and the eighth pre-cut elongated slot (341*d*) are disposed proximal to a different corner proximal to intersecting panel edges (302) on the bamboo layer interior surface (360), wherein the fifth pre-cut elongated slot (341*a*), the sixth pre-cut elongated slot (341*b*), the seventh pre-cut elongated slot (341*c*), and the eighth pre-cut elongated slot (341*d*) are disposed on the bamboo layer interior surface (360) opposed to the first pre-cut elongated slot (340*a*), the second pre-cut elongated slot (340*b*), the third pre-cut elongated slot (340*c*), and the fourth pre-cut elongated slot (340*d*) disposed on the bamboo layer exterior surface (370), wherein the fifth pre-cut elongated slot (341*a*), the sixth pre-cut elongated slot (341*b*), the seventh pre-cut elongated slot (341*c*), and the eighth pre-cut elongated slot (341*d*) comprise an interior slot depth (343) having an interior slot height (345) being equal to an interior layer thickness (305) of the bamboo layer interior surface (360), wherein the first slot (340*a*), the second pre-cut elongated slot (340*b*), the third pre-cut elongated slot (340*c*), and the fourth pre-cut elongated slot (340*d*) comprise an exterior slot depth (342) having an exterior slot height (344) being equal to an exterior layer thickness (304) of the bamboo layer exterior surface (370), wherein the first pre-cut elongated slot (340*a*), the second pre-cut eionated slot (340*b*), the third pre-cut elongated slot (340*c*), and the fourth pre-cut elongated slot (340*d*) are at least 1 inch from a panel edge (302), wherein the fifth pre-cut elongated slot (341*a*), the sixth pre-cut elongated slot (341*b*), the seventh pre-cut elongated slot (341*c*), and the eighth pre-cut elongated slot (341*d*) are at least 1 inch from a panel edge (302); and (e) an attaching screw (350);

wherein the first cabinet module (200) attaches to the second cabinet module (1200) via the attaching screw (350);

wherein the attaching screw (350) passes through the pre-cut elongated slot disposed on the bamboo layer interior surface (360) of the first cabinet module (200), through the substrate (310) of the first cabinet module (200), exiting through the pre-cut elongated slot disposed on the bamboo layer exterior surface (370) of the first cabinet module (200), further driven through the pre-cut elongated slot disposed on the bamboo layer exterior surface (370) on the second cabinet module (200), into and through a portion of, then lodging into the substrate (310) of the second cabinet module (1200);

wherein the first cabinet module (200) may be detached from the second cabinet module (1200), wherein the first cabinet module (200) may be reattached to the second cabinet module (1200).

2. A modular composite cabinet system (100) consisting of a first cabinet module (200) and a second cabinet module (1200), wherein the first cabinet module (200) consists of a first module top side (210), a first module bottom side (220), a first module first side (230), a first module second side (240), a first module back side (260), and a first module front (250), wherein the second cabinet module (1200) consists of a second module top side (1210), a second module bottom side (1220), a second module first side (1230), a second module second side (1240), a second module back side (1260), and a second module front (1250), wherein the first module top side (210), the first module bottom side (220), the first module first side (230), the first module second side (240), the first module back side (260), the second module top side (1210), the second module bottom side (1220), the second module first side (1230), the second module second side (1240), and the second module back side (1260) consist of a composite panel (300), wherein the composite panel (300) consists of:

(a) a substrate (310);

(b) a bamboo layer interior surface (360) disposed on the substrate (310);

(c) a bamboo layer exterior surface (370) disposed on the substrate (310), opposed to the bamboo layer interior surface (360);

(d) a first pre-cut elongated slot (340*a*), a second pre-cut elongated slot (340*b*), a third pre-cut elongated slot (340*c*), and a fourth pre-cut elongated slot (340*d*), wherein the first pre-cut elongated slot (340*a*), the second pre-cut elongated slot (340*b*), the third pre-cut elongated slot (340*c*), and the fourth pre-cut elongated slot (340*d*) are disposed proximal to a different corner proximal to intersecting panel edges (302) on the bamboo layer exterior surface (370), wherein a fifth pre-cut elongated slot (341*a*), a sixth pre-cut elongated slot (341*b*), a seventh pre-cut elongated slot (341*c*), and an eighth pre-cut elongated slot (341*d*) wherein the fifth pre-cut elongated slot (341*a*), the sixth pre-cut elongated slot (341*b*), the seventh pre-cut elongated slot (341*c*), and the eighth pre-cut elongated slot (341*d*) are disposed proximal to a different corner proximal to intersecting panel edges (302) on the bamboo layer interior surface (360), wherein the fifth pre-cut elongated slot (341*a*), the sixth pre-cut elongated slot (341*b*), the seventh pre-cut elongated slot (341*c*), and the eighth pre-cut elongated slot (341*d*) are disposed on the bamboo layer interior surface (360) opposed to the first pre-cut elongated slot (340*a*), the second pre-cut elongated slot (340*b*), the third pre-cut elongated slot (340*c*), and the fourth pre-cut elongated slot (340*d*) disposed on the bamboo layer exterior surface (370), wherein the fifth pre-cut elongated slot (341*a*), the sixth pre-cut elongated slot (341*b*), the seventh pre-cut elongated slot (341*c*), and the eighth pre-cut elongated slot (341*d*) are consist of an interior slot depth (343) having an interior slot height (345) being equal to an interior layer thickness (305) of the bamboo layer interior surface (360), wherein the first pre-cut elongated slot (340*a*), the second pre-cut elongated slot (340*b*), the third pre-cut elongated slot (340*c*), and the fourth pre-cut elongated slot (340*d*) consist of an exterior slot depth (342) having an exterior slot height (344) being equal to an exterior layer thickness (304) of the bamboo layer exterior surface (370), wherein the first pre-cut elongated slot (340*a*), the second pre-cut elongated slot (340*b*), the third pre-cut elongated slot (340*c*), and the fourth pre-cut elongated slot (340*d*) are 1 inch from a panel edge (302), wherein the fifth pre-cut elongated slot (341*a*), the sixth pre-cut elongated slot (341*b*), the seventh pre-cut elongated slot (341*c*), and the eighth pre-cut elongated slot (341*d*) are 1 inch from a panel edge (302); and e) an attaching screw (350);

wherein the first cabinet module (200) attaches to the second cabinet module (1200) via the attaching screw (350), wherein the attaching screw (350) passes through the pre-cut elongated slot disposed on the bamboo layer interior surface (360) of the first cabinet module (200), through the substrate (310) of the first cabinet module (200), exiting through the pre-cut elongated slot disposed on the bamboo layer exterior surface (370) of the first cabinet module (200), further driven through the pre-cut elongated slot disposed on the bamboo layer exterior surface (370) on the second cabinet module (200), into and through a portion of, then lodging into the substrate (310) of the second cabinet module (1200);

wherein the first cabinet module (200) may be detached from the second cabinet module (1200), wherein the first cabinet module (200) may be reattached to the second cabinet module (1200).

* * * * *